US008818212B2

(12) United States Patent
Iwakawa

(10) Patent No.: US 8,818,212 B2
(45) Date of Patent: Aug. 26, 2014

(54) IMAGE FORMING APPARATUS

(75) Inventor: Tadashi Iwakawa, Abiko-shi (JP)

(73) Assignee: Canon Kabushiki Kaisha, Tokyo (JP)

( * ) Notice: Subject to any disclaimer, the term of this patent is extended or adjusted under 35 U.S.C. 154(b) by 211 days.

(21) Appl. No.: 13/339,751

(22) Filed: Dec. 29, 2011

(65) Prior Publication Data

US 2012/0183309 A1 Jul. 19, 2012

(30) Foreign Application Priority Data

Jan. 19, 2011 (JP) ..... 2011-008731

(51) Int. Cl.
*G03G 15/00* (2006.01)
*G03G 15/01* (2006.01)

(52) U.S. Cl.
CPC ..... *G03G 15/657* (2013.01); *G03G 15/0189* (2013.01); *G03G 2215/0129* (2013.01)
USPC ..... 399/21; 399/400

(58) Field of Classification Search
CPC ..... G03G 15/657; G03G 2215/0129; G03G 15/0189
USPC ..... 399/400, 21
See application file for complete search history.

(56) References Cited

U.S. PATENT DOCUMENTS

| | | | | |
|---|---|---|---|---|
| 8,478,183 | B2 * | 7/2013 | Minbu | 399/400 |
| 2010/0109229 | A1 | 5/2010 | Iwakawa | |
| 2010/0215420 | A1 * | 8/2010 | Komiyama et al. | 399/400 |
| 2011/0052291 | A1 | 3/2011 | Iwakawa | |

FOREIGN PATENT DOCUMENTS

JP 2003-327342 A 11/2003

* cited by examiner

*Primary Examiner* — Matthew G Marini
*Assistant Examiner* — Allister Primo
(74) *Attorney, Agent, or Firm* — Fitzpatrick, Cella, Haper & Scinto

(57) ABSTRACT

The image forming apparatus having a suction conveying portion, including a belt member arranged between a transfer portion and a fixing unit, for conveying sheet while suctioning at a conveying face of the belt member, a moving portion which moves the upstream side of a conveying face or downward, and a position controller which controls operation of the moving portion to move the upstream side of the conveying face to a position being close to the transfer portion from a receiving position after sheet fed from the transfer portion is received by the suction conveying portion which is located at the receiving position being apart from the transfer portion.

8 Claims, 9 Drawing Sheets

FIG. 4

| POSITION CONTROL UNIT | | TRANSFER SHEET SIZE | |
|---|---|---|---|
| | | SHORTER THAN DISTANCE BETWEEN TRANSFER PORTION AND FIXING UNIT | LONGER THAN DISTANCE BETWEEN TRANSFER PORTION AND FIXING UNIT |
| BASIS WEIGHT | 52g-SHEET TO 105g-SHEET | OFF | OFF |
| | 106g-SHEET TO 300g-SHEET | ON | OFF |

IMAGE FORMING APPARATUS

BACKGROUND OF THE INVENTION

1. Field of the Invention

The present invention relates to an image forming apparatus in which a suction conveying portion to suction and convey sheet is arranged between a transfer portion to transfer toner images and a fixing unit to fix toner images to the sheet.

2. Description of the Related Art

As is well-known, in an image forming apparatus utilizing an electrophotographic system, a recorded image is obtained by transferring a toner image being a visible image which is borne on a photosensitive member or an intermediate transfer member to transfer material (sheet) such as plain paper. Then, the transfer material to which the toner image is transferred from the photosensitive member or the intermediate transfer member at the transfer portion is discharged after the toner image is fixed as being conveyed to a fixing unit. If the transfer material is conveyed with a pair of normal rollers between the transfer portion and the fixing unit, the non-fixed toner image on the transfer material is damaged. Accordingly, as a structure for transfer material conveying, it is generally structured that a suction conveying portion conveys as suctioning transfer material to an endless belt having a number of suction air holes as suctioning with a fan.

Between the transfer portion and the fixing unit, for example, there may be a case that transfer material is not nipped by neither a transfer nip portion nor a fixing nip portion after being discharged from the transfer portion until conveyed into the fixing unit. In such a case, the transfer sheet must be conveyed only with suction conveying force of the suction conveying portion.

Transfer material having a curl is difficult to be suctioned to the endless belt at the suction conveying portion. Accordingly, there may be a possibility that conveying force cannot be applied to the transfer material and that the transfer material cannot be conveyed to the fixing unit. Further, even in a case that the transfer material is nipped by one of the transfer nip portion and the fixing nip portion, there may be a possibility that a curl at the transfer material causes difficulty of suctioning to the endless belt as well when suctioning force of the suction conveying portion is relatively weak.

Japanese Patent Laid-Open No. 2003-327342 discusses a structure in which a drive roller is protruded upward from a conveying face of an endless belt at the downstream side in the transfer material conveyance direction from the suction conveying portion and conveys a curled transfer material to the fixing unit with the drive roller.

However, the above image forming apparatus in the related art assumes a case that the transfer material front end is curled downward. Actually, a curled direction of a transfer material front end varies according to a state of transfer material set by a user and fixing conditions, conveying path shapes after fixing and an amount of transferred toner for a second face of duplex printing. Accordingly, the curled direction is not uniformly defined.

Accordingly, with the traditional structure in which the drive roller is protruded upward from the conveying face of the endless belt when the transfer material front end is curled upward, the transfer material front end is more unlikely to enter to the fixing unit. Therefore, a conveying error may be caused on the contrary. Even when a conveying error is not caused here, a non-fixed toner image on the transfer material grazes with a guide of the fixing unit to cause an imaging error.

SUMMARY OF THE INVENTION

The present invention provides an image forming apparatus which prevents occurrence of conveying errors between a transfer portion and a fixing unit while preventing occurrence of imaging errors due to grazing with a guide and the like even when transfer sheets are curled.

The present invention is to provide an image forming apparatus, including: a transfer portion which transfers a toner image to sheet; a fixing unit which fixes the toner image transferred by the transfer portion to the sheet; a suction conveying portion which has an endless belt member arranged between the transfer portion and the fixing unit and which conveys a sheet while suctioning sheet at a conveying face of the belt member; a moving portion which moves the belt member so that the upstream side in a sheet conveyance direction of the conveying face of the belt member to be close to the transfer portion or to be apart from the transfer portion; and a position controller which controls operation of the moving portion to move the upstream side of the conveying face of the belt member to a position being close to the transfer portion from a receiving position after sheet fed from the transfer portion is received by the suction conveying portion which is located at the receiving position being apart from the transfer portion.

According to the present invention, it is possible to provide the image forming apparatus which prevents occurrence of conveying errors between the transfer portion and the fixing unit while preventing occurrence of imaging errors due to grazing with a guide and the like even when sheet is curled.

Further features of the present invention will become apparent from the following description of exemplary embodiments with reference to the attached drawings.

BRIEF DESCRIPTION OF THE DRAWINGS

FIG. 4 is a table indicating relation among size, basis weight of transfer sheets and a controller according to the first embodiment;

DESCRIPTION OF THE EMBODIMENTS

In the following, embodiments of the present invention will be described in detail based on examples in an exemplifying manner with reference to the drawings. Here, dimensions, material, shapes, relative positions thereof, and the like of structural components described in the embodiments are to be appropriately varied corresponding to a configuration of an apparatus to which the present invention is applied and various conditions. Therefore, the scope of the present invention is not intended to be limited thereto unless otherwise specified specifically.

First Embodiment

Figure 2:
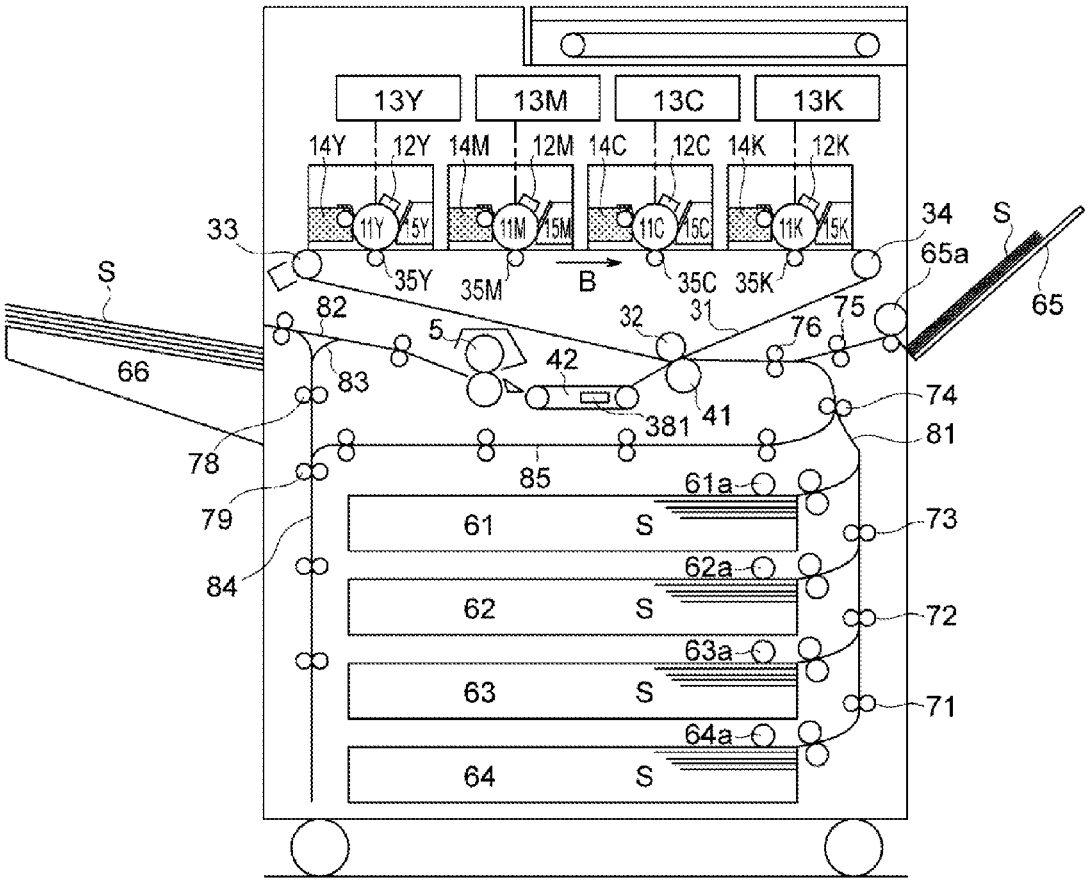
FIG. 2 is a schematic sectional view of an image forming apparatus.

FIG. 2 is a schematic sectional view of an image forming apparatus according to a first embodiment. Here, owing to advantages in adaptability to a variety of transfer material and print productivity, a color image forming apparatus utilizing an electrophotographic system in which four colors of image forming portions are arranged on an intermediate transfer belt is exemplified.

Conveying Process of Transfer Material

Transfer sheets S as transfer material are stored as being stacked at transfer sheet storages 61 to 65 and are fed by feeding portions 61*a* to 65*a* as being synchronized with image forming timing. A transfer sheet S fed by the feeding portions 61*a* to 65*a* is conveyed to a pair of registration rollers 76 being a pre-transfer conveying portion through a conveying path 81 as being conveyed by a pair of conveying rollers 71 to 75. The pair of registration rollers 76 has a function to correct skew feeding as aligning a front end of the transfer sheet S by forming a loop to have the transfer sheet S conveyed from the transfer sheet storages 61 to 65 abut thereto. Further, the pair of registration rollers 76 has a function to convey the transfer sheet S to a secondary transfer portion at predetermined timing as being synchronized with timing of image forming on the transfer sheet S, that is, as being synchronized with a toner image borne on an image bearing member. The pair of registration rollers 76 feeds the transfer sheet S to the secondary transfer portion at the predetermined timing after correcting skew feeding. The secondary transfer portion being a toner image transfer nip portion to the transfer sheet S formed of a secondary transfer inner roller 32 and a secondary transfer outer roller 41 which are mutually opposed transfers a toner image onto the transfer sheet S by applying predetermined pressing force and electrostatic load bias.

Image Forming Process

Following description is performed on an image forming process carried out to the secondary transfer portion at the similar timing to the conveying process of the transfer sheet S to the above-mentioned second transfer portion. The image forming portion mainly includes a photosensitive member 11 (11Y, 11M, 11C, 11K), a charging unit 12 (12Y, 12M, 12C, 12K), an exposing unit 13 (13Y, 13M, 13C, 13K), a developing unit 14 (14Y, 14M, 14C, 14K), a primary transfer unit 35 (35Y, 35M, 35C, 35K), and a photosensitive member cleaner 15 (15Y, 15M, 15C, 15K). A latent image is formed as the exposing unit 13 is operated based on a transmitted signal of image information against the rotating photosensitive member 11 of which surface is evenly charged in advance by the charging unit 12. The electrostatic latent image formed on the photosensitive member 11 is visualized as a toner image on the photosensitive member 11 through toner development by the developing unit 14. Subsequently, the toner image is transferred onto an intermediate transfer belt 31 by applying predetermined pressing force and electrostatic load bias at the primary transfer unit 35. Then, non-transferred toner slightly remaining on the photosensitive member 11 is collected by the photosensitive member cleaner 15 and is prepared for the next image forming.

Four sets of the above-mentioned image forming portions in yellow (Y), magenta (M), cyan (C) and black (Bk) exist in FIG. 2. Naturally, the number of colors is not limited to four and the order of colors is not limited to the above.

Next, description is performed on the intermediate transfer belt 31. The intermediate transfer belt 31 is stretched by rollers such as a drive roller 33, a tension roller 34 and the secondary transfer inner roller 32 and is driven for conveyance in a direction of arrow B in FIG. 2. The image forming processes of the respective colors to be performed in parallel by the respective image forming portions of Y, M, C and Bk are performed at timing as being superimposed on the toner image of an upstream color primarily transferred onto the intermediate transfer belt 31. Consequently, the toner image of full color is finally formed on the intermediate transfer belt 31 and is conveyed to the secondary transfer portion.

Processes After Secondary Transferring

The toner image of full color is secondarily transferred onto the transfer sheet S at the secondary transfer portion with the conveying process of the transfer sheet S and the image forming process which are respectively described above. Subsequently, the transfer sheet S is conveyed to a fixing unit 5 by a suction conveying portion 42. The suction conveying portion 42 includes a fan 381 and conveys the transfer sheet S as being suctioned with the fan 381. A detailed structure of the suction conveying portion 42 will be described later. The fixing unit 5 melts and fixes the toner image on the transfer sheet S with predetermined pressing force due to opposed rollers or belts and heating effect due to a heat source such as a heater in general.

Route selection is performed to convey the transfer sheet S having the fixed image obtained as described above to a discharge conveying path 82 for being directly discharged onto a discharge tray 66 or to a reverse guide path 83 for duplex image forming. When the duplex image forming is required, the transfer sheet S is drawn to a switch-back path 84 from the reverse guide path 83. Then, front-rear ends are switched by forwarding and reversing the rotational direction (i.e., switch-back operation) of a pair of reverse rollers 79, so that the transfer sheet S is conveyed to a duplex conveying path 85. Subsequently, the transfer sheet S is merged once again as being synchronized with a transfer sheet S to be conveyed from any of the feeding portions for a subsequent job and is conveyed to the secondary transfer portion through the pair of registration rollers 76 as similarly to the above. Since the image forming process for the back face (i.e., the second face) is the same as that for the front face (i.e., the first face), description thereof will not be repeated.

Further, in a case that the transfer sheet S is to be inversely discharged, the transfer sheet S is drawn to the switch-back path 84 from the reverse guide path 83 after passing through the fixing unit 5. Then, the transfer sheet S leaves in the opposite direction to the fed direction as setting the rear end at feeding to the leading position owing to inverse rotation of the pairs of reverse rollers 78 and 79 and is discharged to the discharge tray 66.

Position Control of Suction Conveying Portion

Next, position control of the suction conveying portion 42 will be described in detail with reference to FIGS. 1 and 3 to 6.

Figure 1:
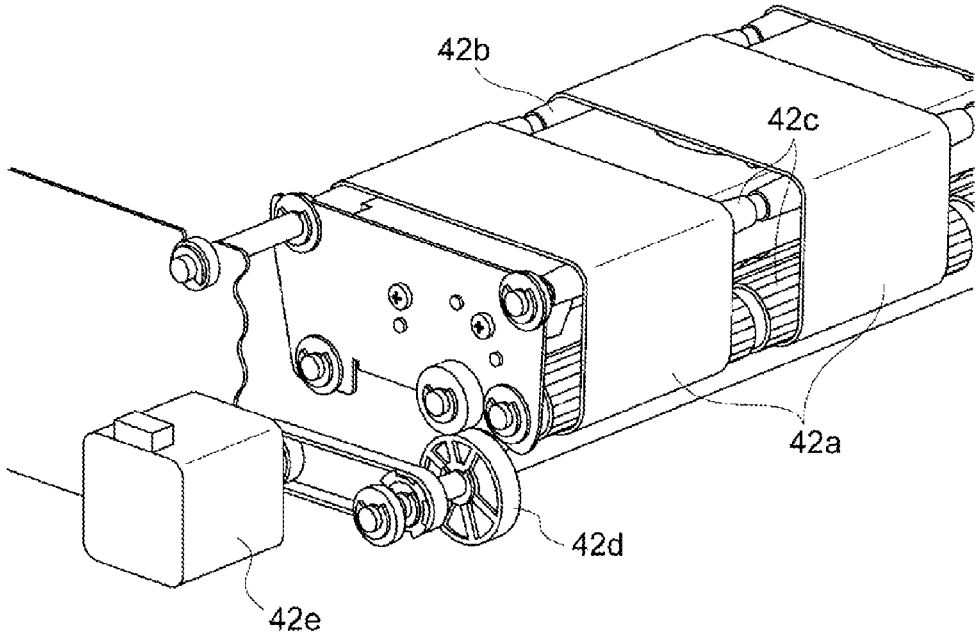
FIG. 1 is a perspective view of a suction conveying portion according to a first embodiment.
Figure 5:
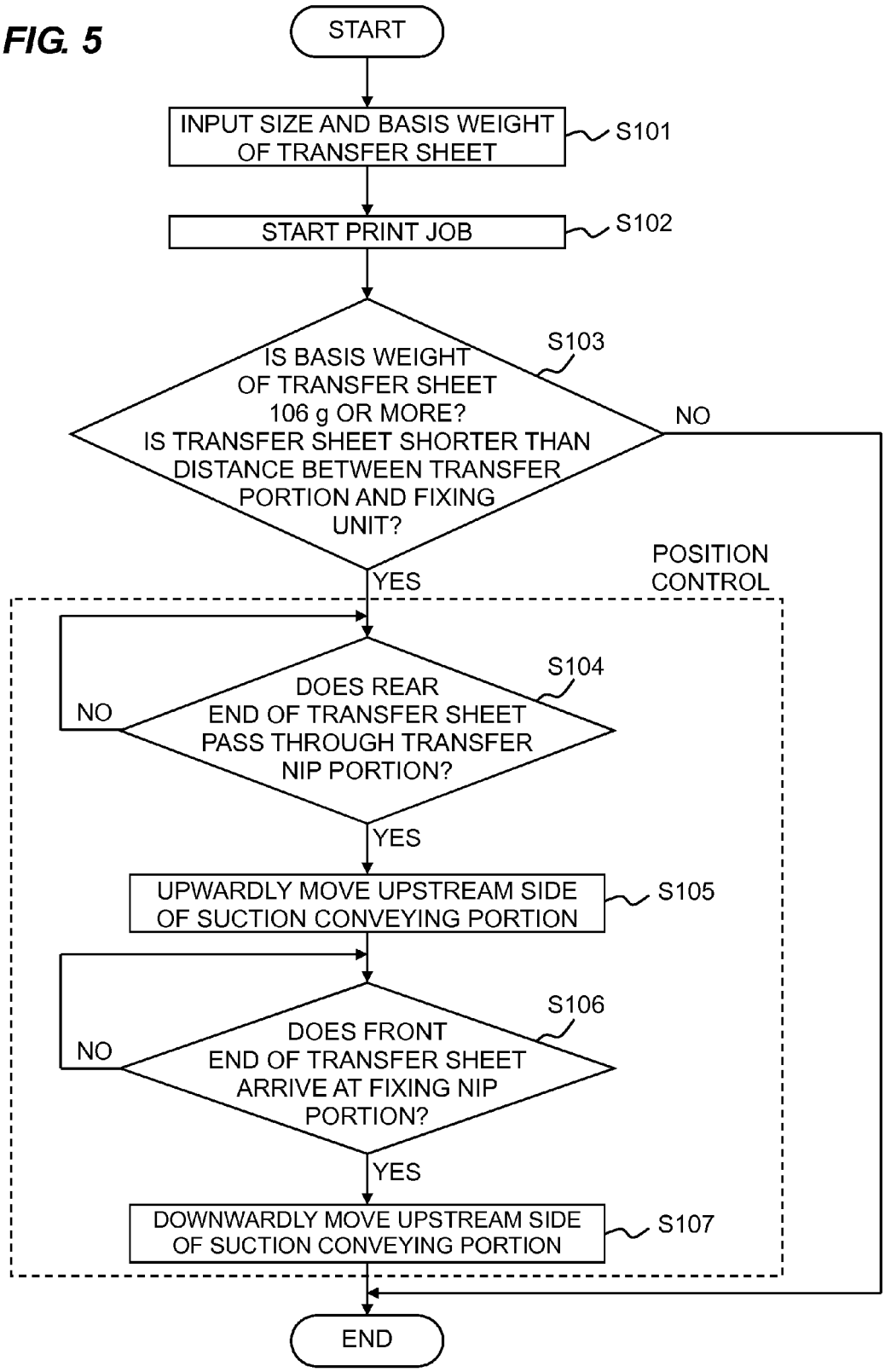
FIG. 5 is a flowchart for operational flow according to the first embodiment.
Figure 6:
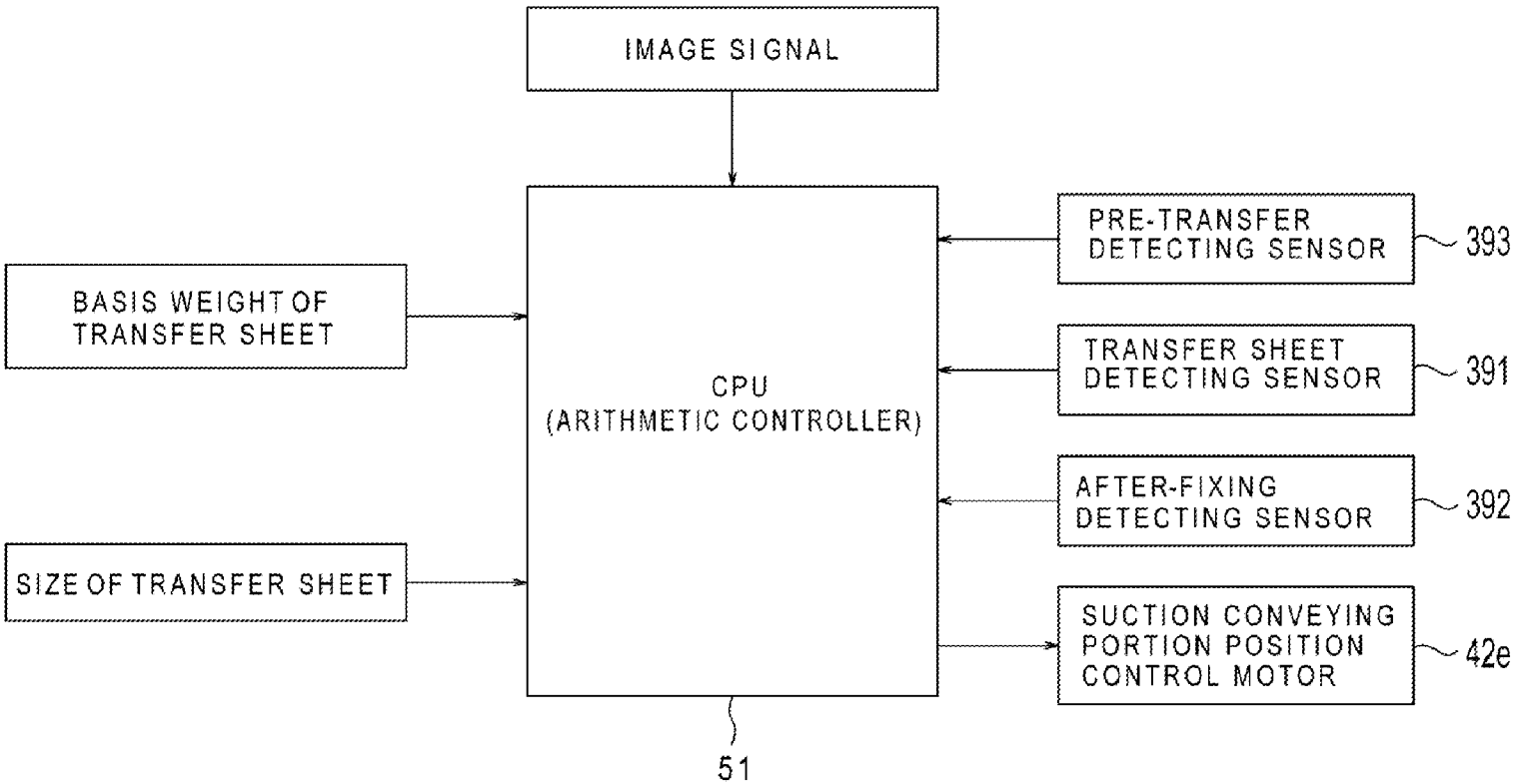
FIG. 6 is a block diagram of a control structure according to the first embodiment.

FIG. 1 is a perspective view of the suction conveying portion 42. FIGS. 3A to 3E are schematic sectional views for describing position control of the suction conveying portion 42 according to the first embodiment. FIG. 4 is a table indicating relation among size, basis weight of transfer sheets S and a controller according to the first embodiment. FIG. 5 is a flowchart for operational flow according to the first embodiment. FIG. 6 is a block diagram of a control structure according to the first embodiment.

As indicated in the table of FIG. 4, the present embodiment exemplifies the image forming apparatus which supports transfer sheets (i.e., transfer material) of which basis weight is between 52 g and 300 g.

A structure of the suction conveying portion 42 and a position controller thereof is described with reference to FIG. 1.

The suction conveying portion 42 is arranged between the secondary transfer portion and the fixing unit 5. The suction conveying portion 42 includes a suction conveying belt (i.e., an endless belt member) 42*a* having a number of suction air holes (not illustrated) and conveys a transfer sheet S as suctioning at a conveying face of the suction conveying belt 42*a*. Specifically, the suction conveying belt 42*a* having a number of suction air holes (not illustrated) is rotatably stretched by a conveying belt drive roller 42*b* and three conveying roller tension rollers 42*c*. The suction conveying belt 42*a* is rotationally driven in the direction to convey the transfer sheet S from the secondary transfer portion to the fixing unit 5. The fan 381 is arranged as a suction portion to suction the transfer sheet S to the suction conveying belt 42*a* in a space at an inner side of the conveying belt drive roller 42*b* and the three conveying belt tension rollers 42*c*.

A cam 42*d* is arranged below the suction conveying portion 42. The cam 42*d* structures a moving portion to move the upstream side in the transfer sheet conveyance direction of the conveying face of the suction conveying belt 42*a* vertically to be close to or to be apart from a transfer sheet. The cam 42*d* vertically moves the upstream side of the suction conveying portion 42 as receiving rotational driving force from a suction conveying portion position control motor 42*e* which is operationally controlled by the controller (a CPU 51 in FIG. 6) being the position controller. That is, the suction conveying portion 42 is rotated about the conveying belt drive roller 42*b* which is arranged at the downstream side of the suction conveying portion 42 owing to the rotation of the cam 42*d*. Accordingly, the upstream side of the suction conveying portion 42 is vertically moved to be close to or to be apart from a transfer sheet.

In the block diagram of FIG. 6, the CPU 51 being the controller receives input of information regarding a type of transfer sheets on which images are formed (e.g., stiffness and size) and information of images formed on the transfer sheets. Here, the information regarding the transfer sheet type is set by a user at an operational panel (i.e., an input portion, not illustrated) and is input to the CPU 51 from the operational panel according to setting of the operational panel.

In the following, the position control of the suction conveying portion 42 will be described based on the perspective view of the suction conveying portion 42 in FIG. 1, the flowchart of FIG. 5, and the block diagram of FIG. 6.

First, transfer sheets S are set by a user in the transfer sheet storages 61 to 65. At that time, the user sets size and basis weight of the transfer sheets S at the operational panel (not illustrated). The information regarding the above setting is input to the CPU 51 (S101).

Here, not limited to setting size and basis weight of transfer sheets directly by a user, the following structure may be adopted, for example. A rear end restriction plate and a side restriction plate which restrict transfer sheets S in the conveyance direction and the width direction perpendicular to the conveyance direction are arranged in the transfer sheet storages 61 to 65. The CPU 51 automatically recognizes size of set transfer sheets S based on a signal from a sensor (i.e., a detecting portion) which detects positions of the rear end restriction plate and the side restriction plate. Further, a media sensor (i.e., a detecting portion) capable of measuring basis weight, thickness and stiffness of the transfer sheets S is arranged in the image forming apparatus, and then, the CPU 51 recognizes information such as the basis weight, thickness and stiffness of the transfer sheets S based on the detection result thereof.

Subsequently, when a print job is started at the image forming apparatus (S102), the transfer sheet S is conveyed pursuant to the transfer sheet conveying process and image forming is performed pursuant to the image forming process. Then, a toner image of full color is secondarily transferred onto the transfer sheet S at the secondary transfer portion.

Here, the CPU 51 determines whether position control operation of the suction conveying portion 42 is performed based on information of the size and basis weight of the transfer sheets S selectively input at the time of starting the print job (S103). In the present embodiment, the position control operation of the suction conveying portion 42 is performed (S104 to S107) in a case that the basis weight of the transfer sheets S is a predetermined value or more (here, 106 g or more) and that the size of the transfer sheets S is shorter than conveying path distance between the secondary transfer portion and the fixing unit, as indicated in FIG. 4. The position control operation of the suction conveying portion 42 is set not to be performed except in the above case.

Figure 3A:
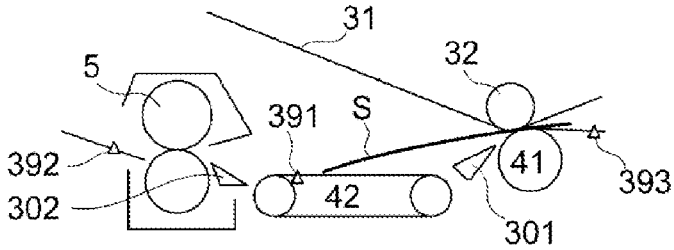
FIGS. 3A to 3E are schematic sectional views for describing position control of the suction conveying portion according to the first embodiment.
Figure 3B:
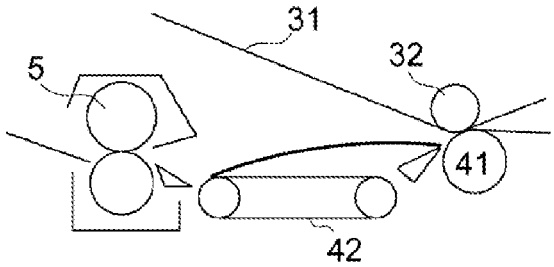
Figure 3C:
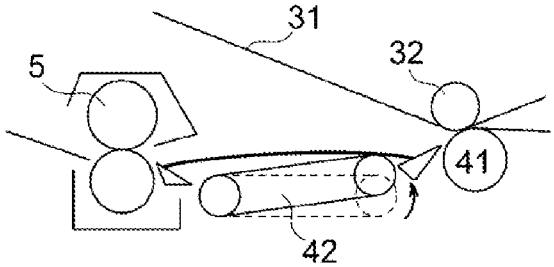
Figure 3D:
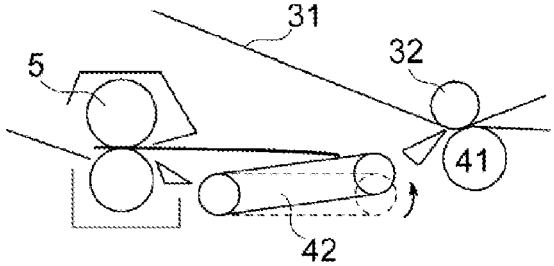
Figure 3E:
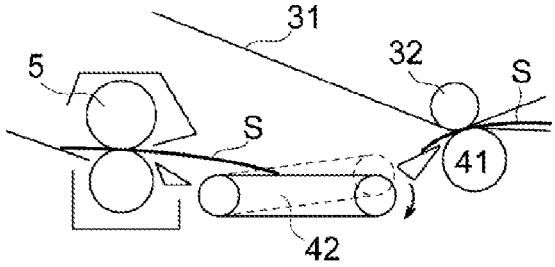

In the case that the position control operation of the suction conveying portion 42 is not performed ("NO" in S103), that is, in the case that the size of the transfer sheets S is equal to or longer than the conveying path distance between the secondary transfer portion and the fixing unit or the basis weight of the transfer sheets S is less than the predetermined value (here, less than 106 g), the transfer sheets S are to be transferred while the suction conveying portion 42 stays at a home position illustrated in FIG. 3A. This is because of the following reasons. In a case that the size of the transfer sheet S is longer than the conveying path distance between the secondary transfer portion and the fixing unit, the transfer sheet S can be conveyed to the fixing nip portion with conveying force at the secondary transfer nip portion even when suctioning force of the suction conveying portion 42 cannot provide conveying force owing to insufficient suctioning of the transfer sheet S having high stiffness to the suction conveying belt 42*a*. Further, even in a case that the size of the transfer sheet S is shorter than the conveying path distance between the secondary transfer portion and the fixing unit, since stiffness of a transfer sheet of which basis weight is less than 106 g is not very high, suctioning to the suction conveying belt 42*a* can be sufficiently performed with suctioning force of the suction conveying portion 42. Accordingly, conveying force can be provided sufficiently even to a curled transfer sheet.

In a case that the size of the transfer sheet S is shorter than the conveying path distance between the secondary transfer portion and the fixing unit and the basis weight of the transfer sheet S is 106 g or more ("YES" in S103), the position control operation of the suction conveying portion 42 is performed with the CPU 51 as follows (S104 to S107).

The suction conveying portion 42 receives the transfer sheet S to which non-fixed toner image is secondarily transferred (see FIG. 3A). Then, after the rear end of the transfer sheet S passes through the secondary transfer nip portion (S104, see FIG. 3B), the upstream side of the suction conveying portion 42 is moved upward (S105, see FIG. 3C) by driving the suction conveying portion position control motor 42*e*. Here, the CPU 51 determines whether the rear end of the transfer sheet S has passed through the secondary transfer nip portion based on a detection signal from a pre-transfer detecting sensor (i.e., a pre-transfer detecting portion) 393 which is arranged, for example, at the upstream side of the conveying path from the secondary transfer nip portion. Accordingly, since the suction conveying portion 42 is abutted to the transfer sheet S passed through the transfer portion, the transfer sheet S is conveyed to the fixing unit 5 as receiving conveying force from the suction conveying portion 42 even when the transfer sheet S is downwardly curled. Here, downward curling denotes curling to cause front and rear ends in the conveyance direction of a transfer sheet to be oriented downward.

Subsequently, when the front end of the transfer sheet S arrives at the fixing nip portion (S106, see FIG. 3D), the upstream side of the suction conveying portion 42 is moved downward (S107, see FIG. 3E) to return to the original position (i.e., the home position) by driving the suction conveying portion position control motor 42*e* in preparation to receive the next transfer sheet. The upstream side of the suction conveying portion 42 is returned to the original position (i.e., the home position) so as to be ready for a transfer sheet to be fed thereafter. Returning of the suction conveying portion 42 to the original position (i.e., the home position) is completed at timing before the front end arrives at the suction conveying portion 42.

Here, in the secondary transfer nip portion of the image forming apparatus utilizing the intermediate transfer belt 31, the secondary transfer outer roller 41 is placed at a position being slightly shifted to the upstream side against the secondary transfer inner roller 32.

One of the reasons to shift the secondary transfer outer roller 41 to the upstream side against the secondary transfer inner roller 32 is that the transfer sheet S is to be easily separated from being drawn to the intermediate transfer belt 31 side by the electrostatic load bias which is applied for transferring the toner image at the secondary transfer nip portion. Another reason thereof is that the discharge direction of the transfer sheets S is desired to be constant at the secondary transfer nip portion. This is because exfoliating electrical discharge occurs between the transfer sheet S and the secondary transfer outer roller 41 when the transfer sheet S is discharged in the direction being apart from the secondary transfer outer roller 41 (i.e., upward), for example, to cause imaging errors with splashed toner.

To receive and convey transfer material to be fed from the secondary transfer nip portion in which the secondary transfer outer roller 41 is arranged at the position being slightly shifted to the upstream side, it is desirable that the suction face of the suction conveying portion 42 is approximately horizontal as the upstream side of the suction conveying portion 42 being located slightly to the lower side.

In the present embodiment, the above-mentioned home position is set as a steady position of the suction conveying portion 42, so that transfer material is smoothly conveyed without causing imaging errors at the secondary transfer portion. Here, the steady position (i.e., the home position) of the suction conveying portion 42 is a receiving position (see FIG. 3A) at which the suction conveying portion 42 receives transfer material to be fed from the transfer portion. Further, at the steady position (i.e., the home position), the upstream side of the suction conveying portion 42 is downwardly apart from the transfer portion against the position at which the upstream side thereof is close to the nip portion of the transfer portion (see FIG. 3C).

In the present sequence to move the suction conveying portion 42, the upstream side of the suction conveying portion 42 is always located at the original position (i.e., the home position) illustrated in FIG. 3A when the rear end of the transfer sheet S is nipped by the secondary transfer nip portion. Therefore, the suction conveying portion 42 which receives transfer sheets from the secondary transfer nip portion is the same as a normal state (i.e., a state without moving the suction conveying portion 42). Accordingly, imaging errors at the secondary transfer portion and separation conveying errors at the nip portion are not caused owing to performing the position control of the suction conveying portion 42.

After the rear end of the transfer sheet S passes through the secondary transfer nip portion, the upstream side of the suction conveying portion 42 is moved upward. Accordingly, the suction conveying portion 42 is abutted to the transfer sheet S more reliably and conveying of the transfer sheet S by the suction conveying portion 42 is performed more reliably.

When the suction conveying portion 42 is kept staying at the original home position, there is a possibility that conveying errors occur as follows, for example. That is, the transfer sheet S and the suction conveying portion 42 may be separated in a state that the front end side of the transfer sheet S is supported by a fixing inlet guide 302 and the rear end side of the transfer sheet S is supported by the secondary transfer outlet guide 301. In this case, the transfer sheet S cannot be suctioned to the suction conveying portion 42. Here, the state that the front and rear ends of the transfer sheet S in the conveyance direction are supported by the fixing inlet guide 302 and the secondary transfer outlet guide 301 is apt to occur when the transfer sheet S has downward curling. When the transfer sheet S is not suctioned to the suction conveying portion 42, the suction conveying portion 42 cannot convey the transfer sheet S to cause conveying errors. In the present embodiment, such conveying errors are eliminated by upwardly moving the upstream side of the suction conveying portion 42 to be abutted to the conveying sheet S.

Further, since the upstream side of the suction conveying portion 42 is moved upward, the front end of the transfer sheet S approaches to a fixing inlet upper guide less obtusely compared to a normal state even when the front end of the transfer sheet S is curled upward. Accordingly, stable conveying ability can be ensured. In addition, it is possible to prevent occurrence of imaging errors caused by grazing of the non-fixed toner image on the transfer sheet with the fixing inlet upper guide.

In the present embodiment, productivity of transfer sheets of which basis weight is 106 g or more is set to be half in view of fixing characteristics. That is, conveying speed when a transfer sheet passes through the secondary transfer portion and the fixing unit is set to be half of conveying speed before transferring and after fixing. Accordingly, in a case that a transfer sheet of which basis weight is 106 g or more passes, inter-sheet time between an antecedent sheet and a subsequent sheet is doubled even when inter-sheet distance between the antecedent sheet and the subsequent sheet is the same. Therefore, it becomes easier to ensure time for performing the above-mentioned position control operation of the suction conveying portion 42.

Further, the image forming apparatus of the present embodiment is set to have the maximum productivity with transfer sheets having predetermined size (here, A4 size or LETTER size). Accordingly, when transfer sheet size is longer than the above, the productivity drops inversely to the length. Here, the productivity denotes the number of transfer sheets on which images are formed per unit time. The maximum productivity denotes the largest number of transfer sheets on which images are formed per unit time. Meanwhile, the productivity when images are formed on transfer sheets which are shorter than A4 size or LETTER size is set to be the same as the A4 size or the LETTER size. That is, when transfer sheets are shorter than A4 size or LETTER size, the productivity is set to be the same as that of A4 size or LETTER size by enlarging the distance between the rear end of the antecedent transfer sheet and the front end of the subsequent transfer sheet (i.e., by controlling feeding distance of transfer material). This is to suppress the following phenomenon. That is, since the transfer sheet shorter than A4 size or LETTER size has shorter length in the width direction perpendicular to the conveyance direction, temperature rise at non-sheet-passing sections is more likely to occur when continuous sheet-passing is performed by fixing rollers in the fixing unit. When a large size sheet is subsequently conveyed in a state of occurrence of temperature rise at non-sheet-passing sections, an imaging error may be caused owing to offset of end part toner to the fixing unit side and the fixing unit may be damaged owing to excessive temperature above heat allowable temperature of fixing members such as a rubber layer. Accordingly, lifetime of the fixing unit may be shortened. Further, in consideration of circulating number of transfer sheets in the image forming apparatus at the time of duplex conveying, the apparatus structure and software for controlling become complicated such that re-feed waiting position of a transfer sheet is newly arranged and driving of conveying rollers is finely separated. This is one of the reasons why the productivity of short transfer sheets is not increased.

In the present embodiment, the conveying path distance between the transfer portion and the fixing unit is set to be shorter than the predetermined size (here, A4 size or LETTER size). That is, the conveying path distance between the transfer portion and the fixing unit is set to be equal to or shorter than length of the longest transfer material size among sizes of transfer sheets with which the image forming apparatus obtains the maximum productivity. Accordingly, the position control operation of the suction conveying portion 42 is not required to be performed with A4 size or LETTER size having the minimum inter-sheet distance between an antecedent sheet and a subsequent sheet. Since the position control operation of the suction conveying portion 42 is performed only with transfer sheets shorter than A4 size or LETTER size, time for performing the position control operation is easily ensured.

Specifically, in the present embodiment, the position control operation is performed only with transfer sheets having basis weight of 106 g or more and being shorter than A4 size or LETTER size. In a case with transfer sheets having basis weight of 106 g or more and being shorter than A4 side or LETTER size, inter-sheet distance (i.e., distance between the rear end of an antecedent sheet and the front end of a subsequent sheet) becomes long by the shortened amount of length compared to a case with A4-size transfer sheets having basis weight of 80 g, for example. In addition, the conveying speed is set to be half as described above. Accordingly, the inter-sheet time (i.e., the time after the rear end of an antecedent sheet passes until the front end of a subsequent sheet arrives) becomes more than double. Thus, in a case with transfer sheets having basis weight of 106 g or more and being shorter than A4 size or LETTER size, time for performing the position control operation of the suction conveying portion 42 is easily ensured. Accordingly, it is not required to lower productivity for performing the position control operation. Here, the time for performing the position control operation of the suction conveying portion 42 denotes time necessary to return the upstream side of the suction conveying portion 42 to the home position before the subsequent transfer sheet arrives at the suction conveying portion 42 from being moved downward.

In the present embodiment, a transfer sheet detecting sensor 391 as a transfer material detecting portion is arranged between the transfer portion and the fixing unit. Further, an after-fixing detecting sensor 392 being an after-fixing detecting portion is arranged at the downstream side from the fixing unit. The sensors detect dwelling and delaying (i.e., jamming) of a transfer sheet at the suction conveying portion 42. The jamming detection will be described in the following.

In a case that the position control operation of the suction conveying portion 42 is performed, dwelling detection time of the transfer sheet detecting sensor 391 arranged between the transfer portion and the fixing unit is set to be longer than that in a normal state. Further, the delaying detection time of the detecting sensor 392 after the fixing unit is set to be longer than that in the normal state. Here, the normal state denotes a case that the position control operation of the suction conveying portion 42 is not performed.

That is, in a case that the vertical operation of the suction conveying portion 42 is not performed, the CPU 51 determines a transfer sheet dwells at the suction conveying portion 42 based on continuous detecting of the transfer sheet by the transfer sheet detecting sensor 391 over first predetermined time (i.e., dwelling detection time). On the other hand, in a case that the vertical operation of the suction conveying portion 42 is performed, the CPU 51 determines that a transfer sheet dwells at the suction conveying portion 42 based on continuous detecting of the transfer sheet by the transfer sheet detecting sensor 391 over second predetermined time which is longer than the first predetermined time.

Further, in a case that the vertical operation of the suction conveying portion 42 is not performed, the CPU 51 determines that delaying occurs at the suction conveying portion 42 as follows. That is, the CPU 51 determines that a transfer sheet delays in a case that a signal of detecting the front end of the transfer sheet from the after-fixing detecting sensor 392 is not received even exceeding third predetermined time (i.e., delaying detection time) after the transfer sheet detection sensor 391 detects the front end of the transfer sheet. On the other hand, in a case that the vertical operation of the suction conveying portion 42 is performed, delaying occurrence at the suction conveying portion 42 is determined as follows. That is, the CPU 51 determines that a transfer sheet delays in a case that a signal of detecting the front end of the transfer sheet from the after-fixing detecting sensor 392 is not received even exceeding fourth predetermined time which is longer than the third predetermined time after the transfer sheet detection sensor 391 detects the front end of the transfer sheet.

When occurrence of dwelling or delaying (i.e., jamming) of a transfer sheet is determined as described above, CPU 51 stops transfer sheet conveying and image forming operation. In addition, CPU 51 informs a user with an operational panel to remove the jammed sheet in the image forming apparatus.

The reason why the dwelling detection time and the delaying detection time are prolonged when the vertical operation of the suction conveying portion 42 is performed as described above is as follows. That is, there may be a case that the transfer sheet S delays by the time amount from the vertical operation of the suction conveying portion 42 is performed until conveying force is applied to the transfer sheet S as being abutted to the suction conveying portion 42. As described above, the inter-sheet time is prolonged when the position control operation of the suction conveying portion 42 is performed. Therefore, even when the dwelling detection time of the transfer sheet detecting sensor arranged between the transfer portion and the fixing unit and the delaying detection time of the transfer sheet detecting sensor arranged at the downstream side from the fixing unit are set to be longer than those in the normal state, there will not arise a problem for the sequence.

In this manner, the transfer sheet S after passing through the fixing unit is conveyed pursuant to the above-mentioned conveying process and is discharged to the discharge tray 66.

As described above, the present embodiment can provide an image forming apparatus which prevents occurrence of conveying errors between a transfer portion and a fixing unit while preventing occurrence of imaging errors due to grazing with a guide and the like as supporting a variety of media and size even with a small-sized curled transfer sheet.

Second Embodiment

Next, description will be performed on a structure to positionally control a delivery conveying guide 43 which is arranged between the secondary transfer portion and a suction conveying portion as a guide member to guide transfer sheets.

A second embodiment is different in swinging the delivery conveying guide 43 from the first embodiment in which the suction conveying portion 42 is swung. In the following, difference from the first embodiment is described in detail while detailed description of similar structures to the first embodiment will not be repeated as giving the same numeral.

In the second embodiment, the delivery conveying guide 43 as the guide member arranged between the secondary transfer portion and the suction conveying portion is supported swingably having the upstream side thereof in the conveyance direction of a transfer sheet as a swinging fulcrum. That is, the delivery conveying guide 43 is arranged so that the downstream side is vertically movable to be close to or to be apart from a transfer sheet as the upstream side being a fulcrum. The delivery conveying guide 43 is moved by a solenoid 401 as a moving portion for conveying guide position switching. Driving of the solenoid 401 is controlled by the CPU 51 (see FIG. 9).

Here, since the conveying process of transfer material (i.e., transfer sheets), the image forming process and the processes after secondary transferring are the same as those of the first embodiment, description thereof will not be repeated.

Position Control of Delivery Conveying Guide

Figure 8:
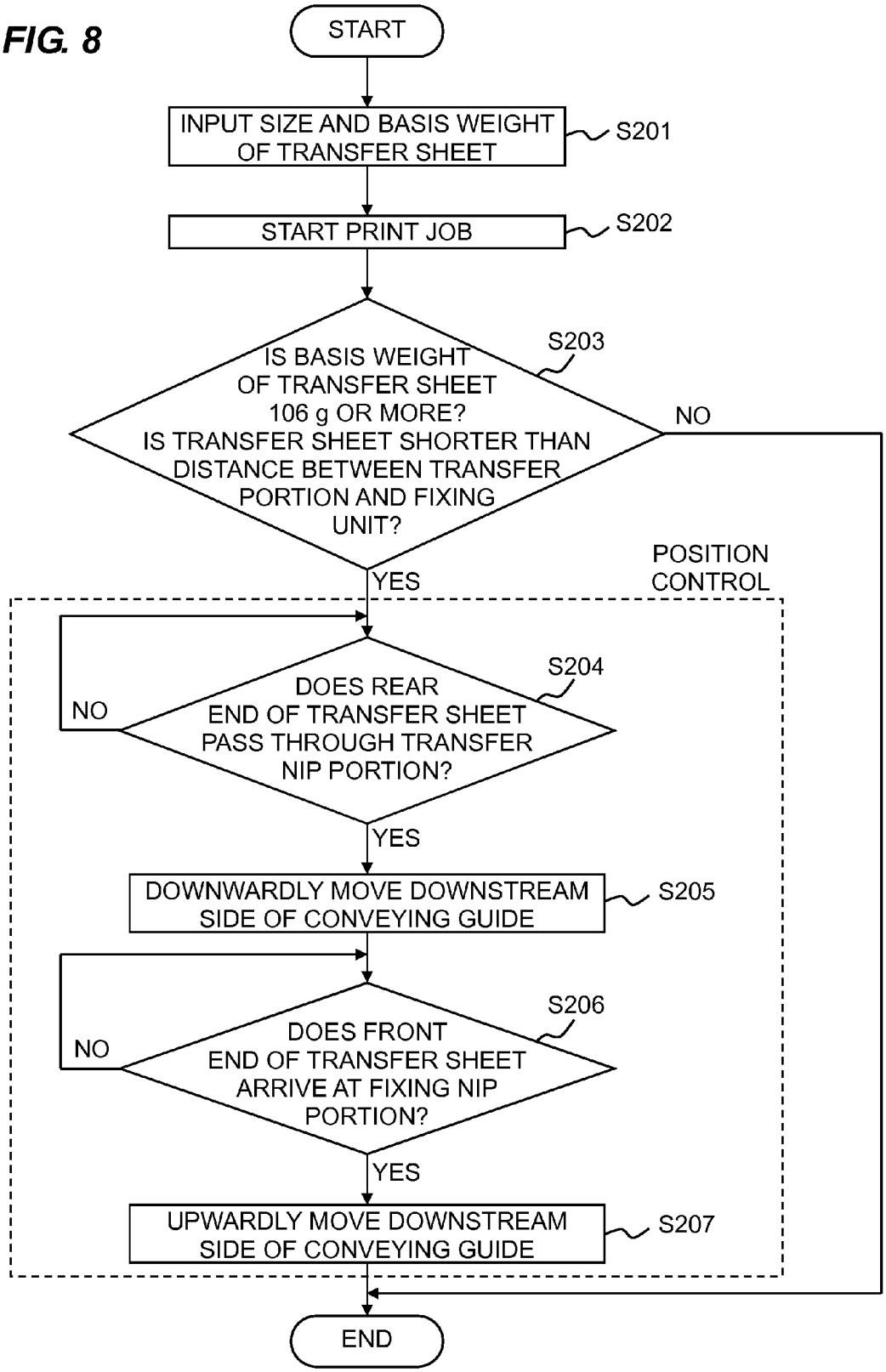
FIG. 8 is a flowchart for operational flow according to the second embodiment.
Figure 9:
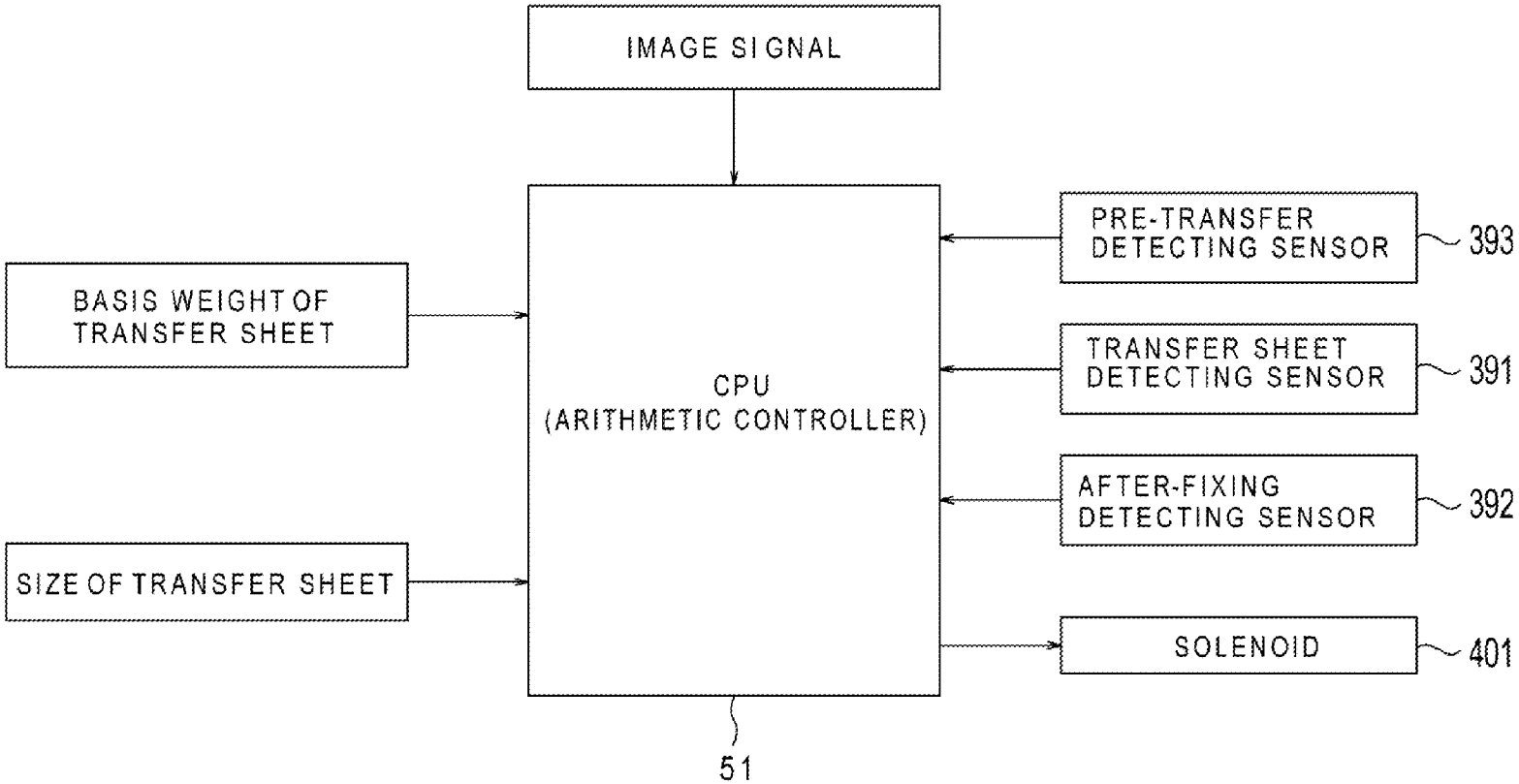
FIG. 9 is a block diagram of a control structure according to the second embodiment.

Next, position control of the delivery conveying guide 43 will be described in detail with reference to FIGS. 7 to 9.

FIGS. 7A to 7E are schematic sectional views for describing position control of the delivery conveying guide 43. FIG. 8 is a flowchart for operational flow according to the second embodiment. FIG. 9 is a block diagram of a control structure according to the second embodiment.

Similarly to the first embodiment (see FIG. 4), the image forming apparatus described in the present embodiment supports transfer sheets (i.e., transfer material) of which basis weight is between 52 g to 300 g.

First, transfer sheets S are set by a user in the transfer sheet storages 61 to 65. At that time, the user sets size and basis weight of the transfer sheets S at the operational panel (not illustrated). The information regarding the above setting is input to the CPU 51 (S201).

Here, not limited to setting size and basis weight of transfer sheets directly by a user, another structure may be adopted similarly to the first embodiment. Specifically, it is also possible to detect size of transfer sheets by utilizing a sensor (i.e., a detecting portion) which detects positions of a side restriction plate and a rear end restriction plate arranged in the transfer sheet storages 61 to 65. Further, it is also possible to detect basis weight, thickness and stiffness of transfer sheets by utilizing a media sensor (i.e., a detecting portion).

Subsequently, when a print job is started at the image forming apparatus (S202), the transfer sheet S is conveyed pursuant to the transfer sheet conveying process and image forming is performed pursuant to the image forming process. Then, a toner image of full color is secondarily transferred onto the transfer sheet S at the secondary transfer portion.

Here, the CPU 51 determines whether position control operation of the delivery conveying guide 43 is performed based on information of the size and basis weight of the transfer sheets S selectively input at the time of starting the print job (S203). In the present embodiment similarly to the first embodiment, the position control operation of the delivery conveying guide 43 is performed (S204 to S207) in a case that the basis weight of the transfer sheets S is a predetermined value or more (here, 106 g or more) and that the size of the transfer sheets S is shorter than conveying path distance between the secondary transfer portion and the fixing unit, as indicated in FIG. 4. The position control operation of the delivery conveying guide 43 is set not to be performed except in the above case.

Figure 7A:
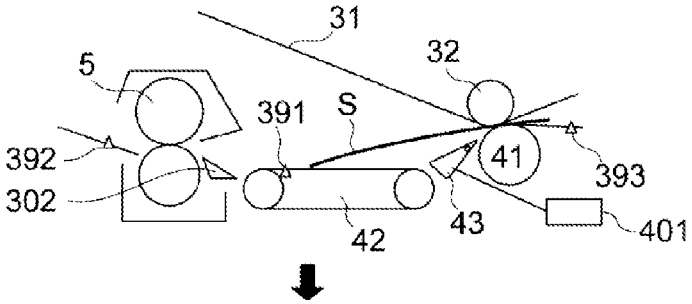
FIGS. 7A to 7E are schematic sectional views for describing position control of a delivery conveying guide according to a second embodiment.
Figure 7B:
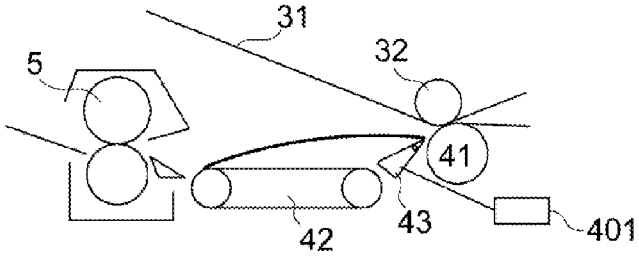
Figure 7C:
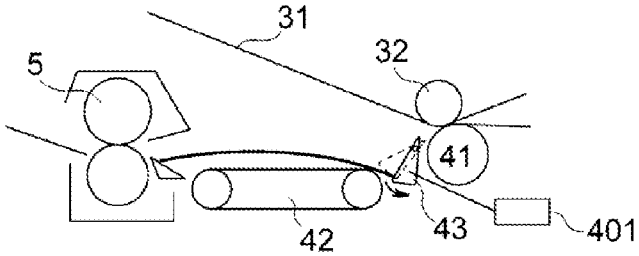
Figure 7D:
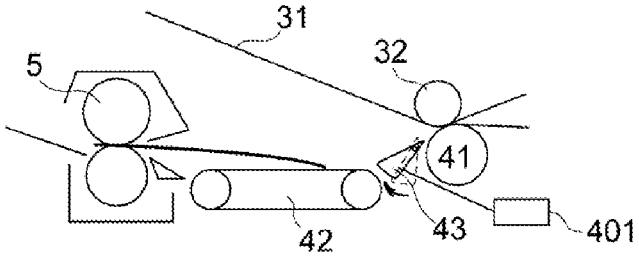
Figure 7E:
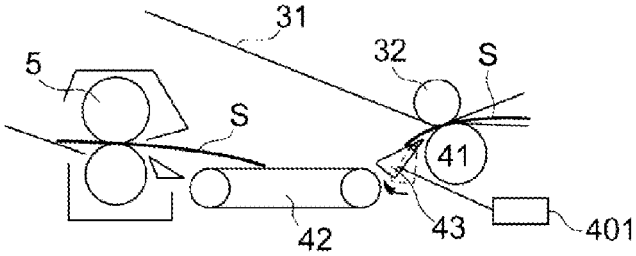

In the case that the position control operation of the delivery conveying guide 43 is not performed ("NO" in S203), that is, in the case that the size of the transfer sheets S is equal to or longer than the conveying path distance between the secondary transfer portion and the fixing unit or the basis weight of the transfer sheets S is less than the predetermined value (here, less than 106 g), the transfer sheets S are to be transferred while the delivery conveying guide 43 stays at a home position illustrated in FIG. 7A. This is because of the following reasons. In a case that the size of the transfer sheet S is longer than the path distance between the secondary transfer portion and the fixing unit, the transfer sheet can be conveyed to the fixing nip portion with conveying force at the secondary transfer nip portion even when suctioning force of the suction conveying portion 42 cannot provide conveying force owing to insufficient suctioning of the transfer sheet S having high stiffness to the suction conveying belt 42*a*. Further, even in a case that the size of the transfer sheet S is shorter than the conveying path distance between the secondary transfer portion and the fixing unit, since stiffness of a transfer sheet of which basis weight is less than 106 g is not very high, suctioning can be sufficiently performed with suctioning force of the suction conveying portion 42. Accordingly, conveying force can be provided sufficiently even to a curled transfer sheet.

In a case that the transfer sheet S is shorter than the conveying path distance between the secondary transfer portion and the fixing unit and the basis weight of the transfer sheet S is 106 g or more ("YES" in S203), the position control operation of the delivery conveying guide 43 is performed with the CPU 51 as follows (S204 to S207).

The delivery conveying guide 43 and the suction conveying portion 42 receive the transfer sheet S to which non-fixed toner image is secondarily transferred (see FIG. 7A). Then, after the rear end of the transfer sheet S passes through the secondary transfer nip portion (S204, see FIG. 7B), the downstream side of the delivery conveying guide 43 is moved downward (S205, see FIG. 7C) by driving the delivery conveying guide position switching solenoid 401. Here, the CPU 51 determines whether the rear end of the transfer sheet S has passed through the secondary transfer nip portion based on a detection signal from the pre-transfer detecting sensor (i.e., a pre-transfer detecting portion) 393 which is arranged, for example, at the upstream side of the conveying path from the secondary transfer nip portion. Accordingly, since the suction conveying portion 42 is abutted to the transfer sheet S passed through the transfer portion, the transfer sheet S is conveyed to the fixing unit 5 as receiving conveying force from the suction conveying portion 42 even when the transfer sheet S is downwardly curled. Here, downward curling denotes curling to cause front and rear ends in the conveyance direction of a transfer sheet to be oriented downward.

Subsequently, when the front end of the transfer sheet S arrives at the fixing nip portion (S206, see FIG. 7D), the downstream side of the delivery conveying guide 43 is moved upward (S207, see FIG. 7E) to return to the original position (i.e., the home position) by driving the delivery conveying guide position switching solenoid 401 in preparation to receive the next transfer sheet. Returning of the downstream side of the delivery conveying guide 43 to the original position (i.e., the home position) is completed at timing before the front end of the subsequent transfer sheet arrives at the delivery conveying guide 43.

Here, a steady position (i.e., the home position) of the delivery conveying guide 43 is a receiving position (see FIG. 7A) at which the delivery conveying guide 43 receives transfer sheets S to be fed from the transfer portion. Further, at the steady position (i.e., the home position), the downstream side of the delivery conveying guide 43 is close to the upstream side of the suction conveying portion 42 against the position at which the downstream side thereof is downwardly apart from the upstream side of the suction conveying portion 42 (see FIG. 7C).

Here, position switching of the downstream side of the delivery conveying guide 43 may be performed at timing after the top end of a transfer sheet S arrives at the suction conveying belt 42*a* as well as at timing after the rear end of the transfer sheet S passes through the secondary transfer nip portion. This is because of the following reason. Once the front end of a transfer sheet with high stiffness causing a conveying error between the transfer portion and the fixing unit is delivered onto the suction conveying belt 42*a*, posture of the transfer sheet to be discharged from the secondary transfer nip portion is not largely varied regardless of presence or absence of the delivery conveying guide 43. Accordingly, an imaging error is not caused at the secondary transfer portion.

Anyhow, even in a case that the position control of the delivery conveying guide 43 is performed, the delivery conveying guide 43 is located at the home position when the delivery conveying guide 43 guides the front end side of a transfer sheet. Accordingly, the transfer sheet discharged from the secondary transfer nip portion is guided by the delivery conveying guide 43 in a state being the same as a normal state (i.e., a state without performing control to change the position of the delivery conveying guide 43). Therefore, imaging errors at the secondary transfer portion and separation conveying errors at the nip portion are not caused.

In the present embodiment, since the position of the suction conveying portion 42 is not changed, the front end of the transfer sheet S approaches to a fixing inlet upper guide less obtusely compared to a normal state even when the front end of the transfer sheet S is curled upward. Accordingly, stable conveying ability can be ensured. In addition, it is possible to prevent occurrence of imaging errors caused by grazing of the non-fixed toner image on the transfer sheet with the fixing inlet upper guide.

Further, in the present embodiment similarly to the first embodiment, the conveying path distance between the transfer portion and the fixing unit is set to be shorter than the predetermined size (here, A4 size or LETTER size).

Furthermore, similarly to the first embodiment, in a case that the position control operation of the delivery conveying guide 43 is performed, dwelling detection time of the transfer sheet detecting sensor 391 arranged between the transfer portion and the fixing unit is set to be longer than that in a normal state. Further, the delaying detection time of the detecting sensor 392 after the fixing unit is set to be longer than that in the normal state. Here, the normal state denotes a case that the position control operation of the delivery conveying guide 43 is not performed.

Here, since the determination for dwelling and delaying of transfer sheets with the CPU is the same as the first embodiment, detailed description will not be repeated.

As described above, the present embodiment can also provide an image forming apparatus which prevents occurrence of conveying errors between a transfer portion and a fixing unit while preventing occurrence of imaging errors due to grazing with a guide and the like as supporting a variety of media and size even with a small-sized curled transfer sheet.

Other Embodiments

In the above embodiments, description is performed on the example that the position control operation of the suction conveying portion 42 is performed in a case that basis weight of transfer sheets S is a predetermined value or more (here, 106 g or more) and the transfer sheets are shorter than conveying path distance between the secondary transfer portion and the fixing unit. However, the present invention is not limited to the above. For example, it is also possible to perform the position control operation of the suction conveying portion 42 even when transfer sheets S of which basis weight is less than the predetermined value. This configuration is preferable with an apparatus having relatively weak suctioning force of the suction conveying portion 42. Further, it is natural that necessity determination of the position control operation according to transfer material size is not required for an image forming apparatus of which distance between the secondary transfer portion and the fixing unit is longer than the longest transfer material which can be supported by the image forming apparatus.

Further, in the above embodiments, four image forming portions are utilized. However, not limited to the above, the number for use may be appropriately set as required.

Further, in the above embodiments, it is also possible that a photosensitive member and process portions acting to the photosensitive member are formed as a cartridge detachably attachable to an image forming apparatus body respectively at each image forming portion. Here, the process portion denotes a charging portion (i.e., a charging unit), a developing portion (i.e., a developing unit), a cleaning portion (i.e., a cleaner) or the like. The cartridge is only required to integrally include the photosensitive member and any one of the process portions.

Furthermore, in the above embodiments, a printer is exemplified as the image forming apparatus. However, the present invention is not limited to the above. It is also possible to adopt another image forming apparatus such as a copying machine, a facsimile machine and a combined machine having functions thereof combined. Further, in the image forming apparatus of the examples having an intermediate transfer member, toner images of respective colors are transferred to the intermediate transfer member in a sequentially superimposed manner and the toner image borne by the intermediate transfer member is transferred collectively to transfer material. However, the present invention is not limited to the above. For example, it is also possible to utilize an image forming apparatus which includes a transfer material bearing member and toner images of respective colors are transferred to the transfer material which is borne by the transfer material bearing member in a sequentially superimposed manner. Similar effects can be obtained by applying the present invention to the image forming apparatuses.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-008731, filed Jan. 19, 2011, which is hereby incorporated by reference herein in its entirety.

What is claimed is:

1. An image forming apparatus, comprising:

a transfer portion which transfers a toner image to sheet;

a sheet recognizing portion which recognizes a position of the sheet;

a fixing unit which fixes the toner image transferred by the transfer portion to the sheet;

a suction conveying portion which has an endless belt member arranged between the transfer portion and the fixing unit and which conveys a sheet while attracting the sheet a conveying face of the belt member by suction;

a moving portion which moves the belt member so that the upstream side in a sheet conveyance direction of the conveying face of the belt member is moved close to the transfer portion or apart from the transfer portion; and a position controller which controls the moving portion so as to move the upstream side of the conveying face of the belt member to a position close to the transfer portion when the sheet recognizing portion determines that a rear end of a sheet fed from the transfer portion has passed through the transfer portion and a front end of the sheet has not reached the fixing unit.

2. The image forming apparatus according to claim 1, further comprising an acquiring portion which acquires information of the sheet, wherein the position controller keeps the suction conveying portion at a receiving position which is a position for receiving the sheet conveyed from the transfer portion in a case where length information of the sheet in the conveyance direction acquired by the acquiring portion is longer than conveying path distance between the transfer portion and the fixing unit or in a case where a sheet basis weight acquired by the acquiring portion is less than a predetermined value.

3. The image forming apparatus according to claim 2, wherein the sheet recognizing portion is arranged between the transfer portion and the fixing unit, wherein the position controller determines that a sheet is jammed when the sheet recognizing portion recognizes the sheet after a predetermined time, and the position controller sets the predetermined time longer in a case where the upstream side of the conveying face of the belt member is moved from the receiving position to close to the transfer portion than the predetermined time in a case that the upstream side of the conveying face of the belt member is kept staying at the receiving position.

4. The image forming apparatus according to claim 2, further comprising:

an after-fixing detecting portion which is arranged at the downstream side in the sheet conveyance direction from the fixing unit and which detects sheet; and a sheet detecting portion which is arranged at the upstream side in the sheet conveyance direction from the after-fixing detecting portion and which detects sheet, wherein the position controller determines that sheet is jammed when the after-fixing detecting portion does not detect the sheet even exceeding predetermined time after the sheet detecting portion detects the sheet, and the position controller sets the predetermined time longer in a case that the upstream side of the conveying face of the belt member is moved from the receiving position to a position being close to the transfer portion than the predetermined time in a case that the upstream side of the suction conveying portion is kept staying at the receiving position.

5. The image forming apparatus according to claim 1, wherein conveying path distance between the transfer portion and the fixing unit is set shorter than length in the conveyance direction of sheet of the longest transfer material size among sizes of transfer sheets with which the image forming apparatus obtains the maximum productivity.

6. The image forming apparatus according to claim 1, further comprising a first guide for guiding the sheet, which is disposed between the transfer portion and the belt member, and a second guide for guiding the sheet, which is disposed between the belt member and the fixing unit.

7. The image forming apparatus according to claim 1, wherein the belt member conveys the sheet approximately horizontally, and the moving portion moves an upstream side of the belt member upward.

8. The image forming apparatus according to claim 1, wherein the moving portion swings the suction conveying portion on a fulcrum disposed at a downstream side in a sheet conveying direction.

* * * * *